US007106986B2

(12) United States Patent
Nakayama

(10) Patent No.: US 7,106,986 B2
(45) Date of Patent: Sep. 12, 2006

(54) FIXING APPARATUS

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,704

(22) Filed: Oct. 21, 2005

(65) Prior Publication Data

US 2006/0088326 A1 Apr. 27, 2006

(30) Foreign Application Priority Data

Oct. 22, 2004 (JP) ..... 2004-308089

(51) Int. Cl.
*G03G 15/20* (2006.01)

(52) U.S. Cl. ..... 399/69; 399/67; 399/328; 399/33; 399/122

(58) Field of Classification Search ..... 399/69, 399/33, 122, 320, 67, 328
See application file for complete search history.

(56) References Cited

U.S. PATENT DOCUMENTS 5,144,360 A * 9/1992 Ishida ..... 355/405
5,428,430 A * 6/1995 Aslam et al. ..... 399/307
5,550,621 A * 8/1996 Ogawahara ..... 399/69
5,802,444 A * 9/1998 Takeuchi et al. ..... 399/384
6,871,040 B1 * 3/2005 Tani et al. ..... 399/329
2002/0141775 A1 * 10/2002 Mitsuoka et al. ..... 399/69
2003/0059224 A1 * 3/2003 Tomita et al. ..... 399/88

FOREIGN PATENT DOCUMENTS

| | | |
|---|---|---|
| JP | 5-107983 | 4/1993 |
| JP | 6-19346 | 1/1994 |
| JP | 6-242701 | 9/1994 |
| JP | 2003-76209 | 3/2003 |
| JP | 2004-102104 | 7/2004 |

* cited by examiner

*Primary Examiner*—David M. Gray
*Assistant Examiner*—Geoffrey T Evans
(74) *Attorney, Agent, or Firm*—Fitzpatrick, Cella, Harper & Scinto

(57) ABSTRACT

A fixing apparatus of an image forming apparatus with high productivity for heavy paper is provided that prevents an abnormal temperature rise of a heated material after a continuous printing operation of heavy paper ends. If the value of a temperature sensor that is provided in a non-passing region of the heated material is equal to or greater than a predetermined value at the end of the continuous printing, the cooling device of a pressure member is operated before the apparatus is put into a standby state, so that the heating member is rotated while the pressure member presses the heating member.

9 Claims, 8 Drawing Sheets

| NUMERIC VALUE / BASIS WEIGHT | 1～10 | 10～100 | 100～ |
|---|---|---|---|
| 64～105 | 0 | 0 | 0 |
| 106～156 | 0 | 0 | 1 |
| 157～256 | 0 | 1 | 1 |

*Fig.6*

FIXING APPARATUS

BACKGROUND OF THE INVENTION

1. Field of the Invention

The present invention relates to image forming apparatuses by the electrophotographic technique, and mote particularly, to image forming apparatuses such as copying machines, printers, and facsimile machines.

2. Description of the Related Art

In a conventional image forming apparatus by the electrophotographic method, a fixing apparatus of a paired heat roller type with a heating roller and a pressure roller is normally employed. Also, a fixing apparatus with seamless belts as a heating member and a pressure member has been known.

In such a fixing apparatus that melts toner with heat generated by a heating member, heat is required for melting the toner. Accordingly, a large quantity of heat is necessary to increase the number of recording sheets on which fixing is performed in unit time (i.e., the productivity). As the basis weight of the recording material to be used is large, the quantity of heat required for fixing an image on the recording material increases. As a result, an even larger quantity of heat is required.

In a case where a full-color image is fixed as an output image, a large quantity of heat is required, as the amount of toner to be fixed is larger than the amount of toner required for mono-color printing, and the toner needs to be melted for a glossier image.

With an electrophotographic image forming apparatus, there is a demand for full-color image output with a productivity of 50 ppm or higher on heavy paper of a basis weight of 100 g/m$^2$. In a case where an output is made on heavy paper with a high productivity, a large quantity of heat is necessary.

As the electric power that is used to meet the above demand increases, the quantity of heat accumulated on the heating roller increases. Especially, in a full-color fixing apparatus that needs to have an elastic layer covering the heating roller, the elastic layer serves as a heat insulating layer. Accordingly, the quantity of heat accumulated on the heating roller further increases, resulting in a high temperature of the core metal.

When a printing operation ends while the core metal of the heating roller is at a high temperature, the quantity of heat to be absorbed by the recording material suddenly loses a place to escape. As a result, the heat accumulated on the core metal increases the temperature of the entire roller, and an abnormal temperature rise is caused on the surface of the heating roller. With such an abnormal temperature rise, the following problems are observed.

That is, the first problem is that the toner to be originally fixed on the recording material is offset on the surface of the fixing roller, because the fixing operation is performed while the temperature of the fixing roller is very high. As a result, a defective image with a hot offset is caused, as the offset toner adheres to a recording material to be transferred to the fixing apparatus next.

So as to avoid the first problem, the printing operation may be prohibited and the apparatus may be put into a standby state until the temperature of the surface of the fixing roller drops to a predetermined temperature. However, because of the large capacity of heat, the waiting period might last for several minutes, which is undesirable in terms of usability. This is the second problem.

So as to eliminate the above problems, Japanese Unexamined Patent Publication No. 2004-102104 discloses a method by which the printing temperature control for the fixing apparatus is suspended before the fixing on the last page is completed, and the heating operation is then suspended or moved on to a rotation temperature control process. More specifically, in a case where the printer engine cannot recognize the number of pages formed by the image data, whether the operation should be performed is determined from the existence of data at the start of image formation at the first development station. If the number of pages in a job can be recognized, the timing of the operation is determined in advance based on the number of pages through reverse calculation started from the end of the fixing.

However, there are the following problems with the image forming apparatus of the above described prior art.

The technique disclosed in Japanese Unexamined Patent Publication No. 2004-102104 is effective for a fixing apparatus with a heating roller with a small quantity of heat and high thermal responsiveness. However, since a large-diameter heating roller is employed in a fixing apparatus that needs to exhibit a high productivity with heavy paper, the heat capacity is high and the thermal responsiveness is poor. As a result, a sufficient effect cannot be expected.

So as to secure fixability and glossiness on heavy paper in a belt-type fixing apparatus suitable for achieving a wide nip, the temperature of the pressure pad provided in the belt for preventing slippage of the belt is preferably maintained at a low temperature. Therefore, in a standby state in which printing is not performed, the pressure pad as well as the belt should preferably be separated from the heating roller.

However, after the belt is separated from the heating roller, the heat cannot escape from the heating roller to the belt. As a result, an abnormal temperature rise is caused in the heating roller for the above described reasons.

SUMMARY OF THE INVENTION

The object of the present invention is to provide an image forming apparatus that can restrict an abnormal temperature rise of the fixing rotating member even after a fixing operation ends.

A first aspect of the present invention is characterized by a fixing apparatus that comprise: a fixing rotating member that heat-fixes an image formed on a recording material; a belt that forms a fixing nip with the fixing rotating member; a temperature control unit that controls the temperature of the fixing rotating member; a contact and separation unit that brings the belt into contact with the fixing rotating member and separates the belt from the fixing rotating member; and a cooling unit that cools the belt, wherein the belt is separated from the fixing rotating member after the operation of cooling the fixing rotating member via the belt is performed when a fixing operation ends.

A second aspect of the present invention is characterized by a fixing apparatus that comprise: a fixing rotating member that heat-fixes an image formed on a recording material; a belt that forms a fixing nip with the fixing rotating member; a temperature control unit that controls the temperature of the fixing rotating member; and a cooling unit that cools the belt, wherein an operation of cooling the fixing rotating member via the belt is changed in accordance with the number of recording materials on which a fixing operation is performed in an image forming job.

A third aspect of the present invention is characterized by a fixing apparatus that comprise: a fixing rotating member that heat-fixes an image formed on a recording material; a belt that forms a fixing nip with the fixing rotating member; a control unit that controls the temperature of the fixing rotating member; and a cooling unit that cools the belt, wherein an operation of cooling the fixing rotating member via the belt is changed in accordance with the basis weight of the recording material on which a fixing operation is performed in an image forming job.

BRIEF DESCRIPTION OF THE DRAWINGS

FIG. 6 is a table showing the criteria for abnormal temperature rises;

DESCRIPTION OF THE PREFERRED EMBODIMENTS

Figure 1:
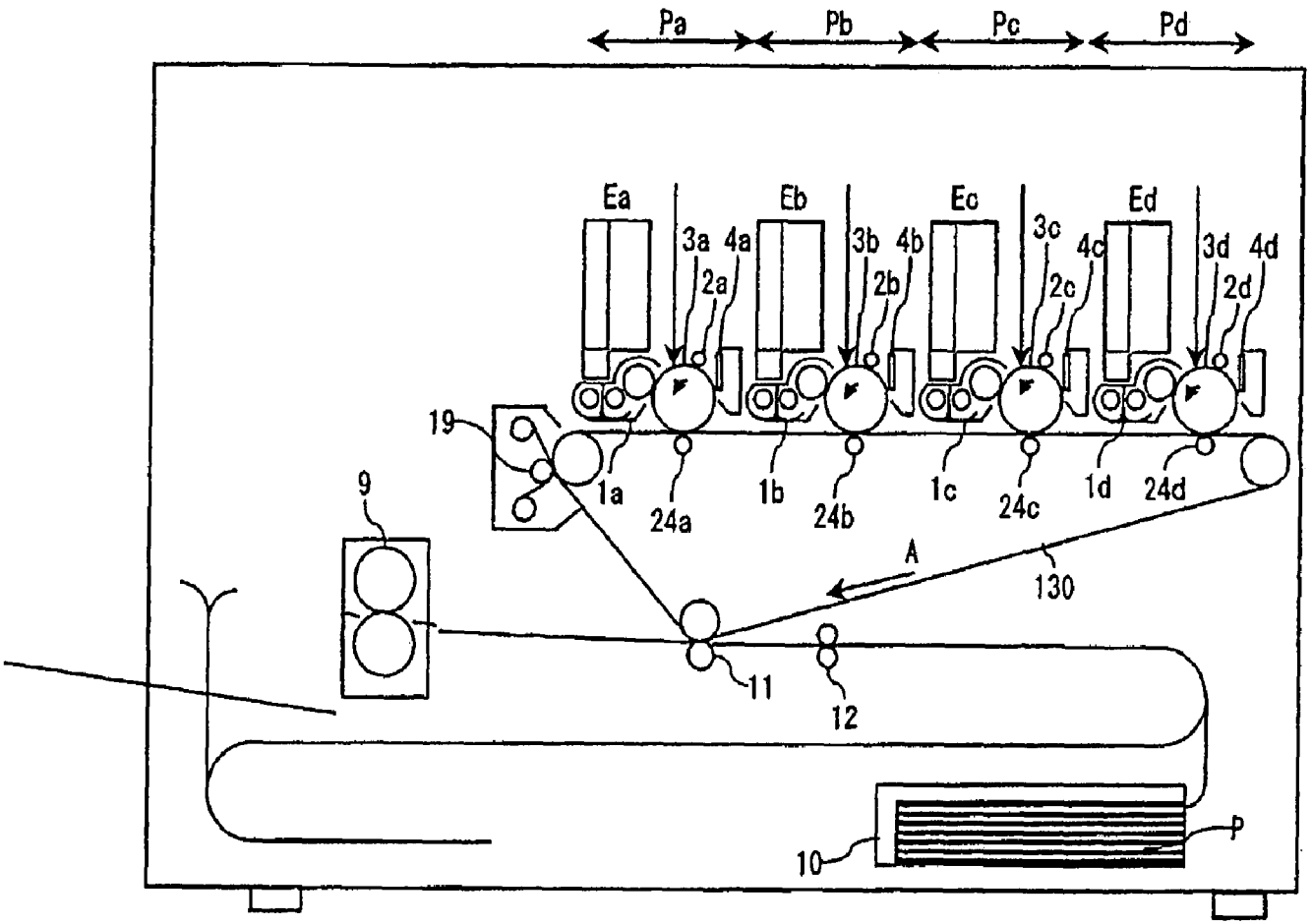
FIG. 1 is a schematic diagram of an image forming apparatus in accordance with the present invention.

The following is a description of image forming apparatuses in accordance with the embodiments of the present invention, with reference to the accompanying drawings. In the drawings, like components are denoted by like reference numerals.

(First Embodiment)

First, an image forming apparatus in accordance with a first embodiment of the present invention is described. FIG. 1 illustrates the image forming apparatus in accordance with the first embodiment.

As shown in FIG. 1, the image forming apparatus includes first through fourth image forming units Pa, Pb, Pc, and Pd that form toner images of different colors through the processes of latent image formation, development, and transfer.

The image forming units Pa, Pb, Pc, and Pd are equipped with image bearing members that are electrophotographic photosensitive drums 3*a*, 3*b*, 3*c*, and 3*d* in this embodiment. Toner images of different colors are formed on the respective photosensitive drums 3*a*, 3*b*, 3*c*, and 3*d*.

An intermediate transfer member 130 is located in the vicinity of the photosensitive drums 3*a*, 3*b*, 3*c*, and 3*d*, so that toner images of the various colors formed on the respective photosensitive drums 3*a*, 3*b*, 3*c*, and 3*d* are preliminarily transferred onto the intermediate transfer member 130, and are transferred onto a recording material P by a secondary transfer member. The toner image transferred onto the recording material P is fixed through heating and pressurizing by a fixing unit 9. The recording material P is then discharged as a recording image to the outside of the apparatus.

Drum chargers 2*a*, 2*b*, 2*c*, and 2*d*, development units 1*a*, 1*b*, 1*c*, and 1*d*, primary transfer chargers 24*a*, 24*b*, 24*c*, and 24*d*, and cleaners 4*a*, 4*b*, 4*c*, and 4*d* are disposed on the outer peripheries of the photosensitive drums 3*a*, 3*b*, 3*c*, and 3*d*. A light source unit (not shown) and a rotary polygon mirror (not shown) are provided at the upper part of the apparatus.

Laser beams emitted from the light source unit are scanned by the polygon mirror. The flux of scanned light is deflected by a reflecting mirror, and is concentrated on bus lines of the photosensitive drums 3*a*, 3*b*, 3*c*, and 3*d* by an FΘ lens. Exposure is then carried out. As a result, latent images in accordance with an image signal are formed on the photosensitive drums 3*a*, 3*b*, 3*c*, and 3*d*. The development units 1*a*, 1*b*, 1*c*, and 1*d* are filled with predetermined amounts of toners of cyan, magenta, yellow, and black as developer by a supply unit (not shown). The development units 1*a*, 1*b*, 1*c*, and 1*d* develop the latent images on the photosensitive drums 3*a*, 3*b*, 3*c*, and 3*d*, to visualize the cyan toner image, the magenta toner image, the yellow toner image, and the black toner image.

The intermediate transfer member 130 is driven to rotate at the same peripheral speed as the photosensitive drums 3 in the direction of the arrow.

The yellow (the first color) toner image that is formed and held on the photosensitive drum 3*a* is transferred onto the intermediate transfer member 130 while it passes through the nip portion between the photosensitive drum 3*a* and the intermediate transfer member 130. At this point, the yellow toner image is intermediately transferred onto the outer peripheral surface of the intermediate transfer member 130 by the electric field and the pressure caused by a primary transfer bias applied to the transfer member 130.

A secondary transfer roller 11 is borne in parallel with the intermediate transfer member 130 and is in contact with the lower surface of the intermediate transfer member 130. A secondary transfer bias is applied to the secondary transfer roller 11 by a secondary transfer bias source. The recording material P is fed from a paper feeder cassette 10 to the contact nip between the intermediate transfer member 130 and the secondary transfer roller 11 via a registration roller 12 and a pre-transfer guide. The combined color toner image overlapped and transferred onto the intermediate transfer member 130 is then transferred onto the fed recording material P. At this point, the secondary transfer bias is applied from the bias source to the secondary transfer roller 11. By virtue of the secondary transfer bias, the combined color toner image is transferred from the intermediate transfer member 130 onto the recording material P.

The magenta (the second color) toner image, the cyan (the third color) toner image, and the black (the fourth color) toner image are then overlapped and transferred onto the intermediate transfer member 130, thereby forming the combined color toner image corresponding to the desired color image.

After the primary transfer, cleaners 4*a*, 4*b*, 4*c*, and 4*d* clean and remove the transfer residual toner from the photosensitive drums 3*a*, 3*b*, 3*c*, and 3*d*, which are prepared for latent image formation that follow. A cleaning web (non-woven fabric) 19 is brought into contact with the surface of the intermediate transfer member 130 so as to wipe off the residual toner and other foreign matters on the intermediate transfer member 130, which is a transfer belt. The transfer materials P onto which the toner images have been transferred are introduced into the fixing unit 9, and the toner images are fixed by heat and pressure applied onto the transfer materials P.

Figure 2:
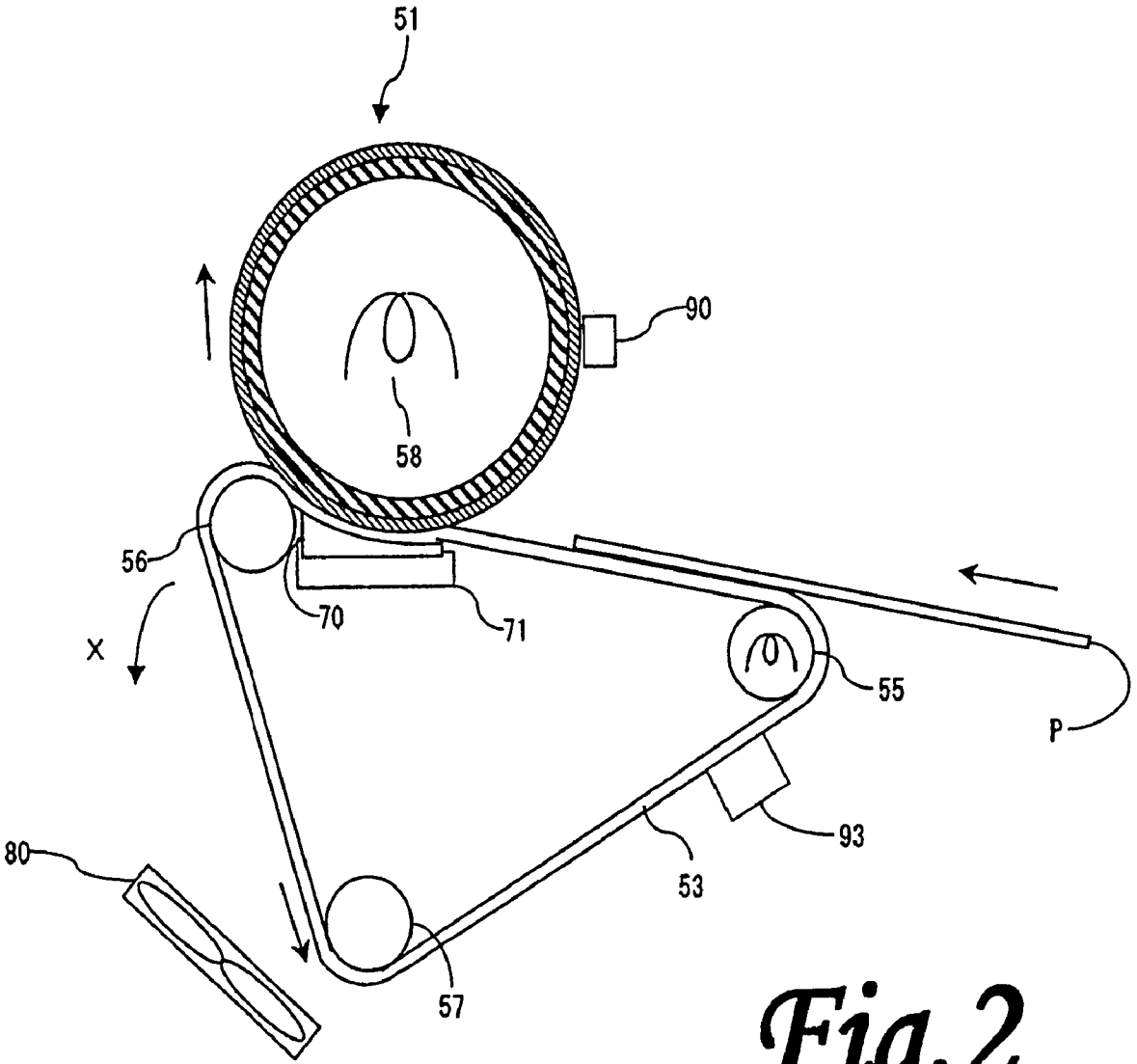
FIG. 2 is a schematic diagram of the fixing apparatus of the image forming apparatus in accordance with the present invention.

Next, the fixing unit 9 in accordance with the first embodiment is described in conjunction with FIG. 2.

As shown in FIG. 2, a fixing roller 51 has a structure that is formed by placing an elastic layer of silicone rubber or fluorine rubber to cover a hollow metal cylinder made of Al with an outer diameter of 80 mm and a thickness of 3.0 mm. The elastic layer is formed by molding silicone rubber into a 2.5 mm sheet of 20 degrees in hardness (JIS-A, weight: 1 kg). The elastic layer is covered with a surface layer of fluorine resin such as a PFA tube of 10 μm to 100 μm in thickness.

An endless pressure belt (a fixing belt) 53 is rotatably supported by rollers 55 through 57.

The pressure belt 53 is brought into contact with the fixing roller 51. A pressure member that includes a pressure pad 70 and a pressure pad supporting member 71 causes the pressure belt 53 to apply pressure to the fixing roller 51 via a sliding member (not shown) from the inside of the pressure belt 53, thereby forming a fixing nip portion N in the fixing apparatus by a belt fixing method.

The fixing roller 51 rotates clockwise as indicated by the arrow. Following the rotation of the fixing roller 51, the pressure belt 53 rotates in the direction indicated by the arrows.

The pressure belt 53 is formed by covering the surface of a base member made of resin such as polyimide or metal such as nickel (Ni) with an elastic layer of silicone rubber or fluorine rubber. The elastic layer may be covered with a surface layer of fluorine resin such as a PFA tube of 10 μm to 100 μm in thickness.

A halogen heater 58 that is a heat source is provided in the fixing roller 51. A main thermistor 90 is in contact with the paper passing potion located substantially at the center of the fixing roller 51 in its longitudinal direction. The main thermistor 90 controls the voltage supply to the heater via a temperature control circuit (CPU). As a result, temperature adjustment is performed so that the temperature of the surface of the fixing roller 51 becomes 180° C. Further, a sub thermistor 91 is in contact with a paper non-passing portion located at an edge (outside the region through which a recording material with the maximum width for use passes) of the longitudinal direction of the fixing roller 51.

Among the rollers 55 through 57 that support the pressure belt 53, the roller 56 is a separation roller made of metal. The roller 56 is buried in the fixing roller 51 by the pressure belt 53 applying pressure onto the roller 56, so that the elastic body of the fixing roller 51 is deformed and the recording material P is separated from the surface of the fixing roller 51.

The roller 56 is also rotatable in the direction of the arrow X, with the roller 55 being the center of rotation. As described later, the roller 56 rotates to separate the pressure belt 53 from the fixing roller 51, so that the fixing operation is finished and moves on to a standby state. On the other hand, when the pressure belt 53 is brought into the fixing roller 51 so that the fixing operation moves from a standby state on to an operating state, the roller 56 rotates in the opposite direction from the direction of the arrow X.

A heater for heating the pressure belt 53 is provided in the roller 55, and the voltage supply to the heater is controlled through the temperature control circuit (CPU) in accordance with the temperature of the pressure belt 53 detected by a belt thermistor 93.

The pressure pad 70 is formed by placing an elastic material such as silicone rubber or fluorine rubber on a metal base. The pressure pad 70 presses the fixing roller 51 via the pressure belt 53. So as to reduce the sliding resistance, a resin sheet should preferably be disposed between the pressure pad 70 and the pressure belt 53, and a lubricant agent should be applied to the inner surface of the pressure belt 53.

The fixing roller 51, the endless pressure belt 53, and the pressure pad 70 constitute the fixing nip portion N. The fixing nip portion N can be made so wide as to wind around the outer periphery of the fixing roller 51 by the endless pressure belt 53. Accordingly, high-speed operation can be realized, and fixing to a thick paper sheet or the like can be made easier.

Also, pressure is applied so that the separation roller 61 cuts into the surface of the fixing roller 51. Accordingly, even higher detachability than in the first embodiment can be achieved, and an operation can be advantageously performed at a higher speed. Cooling fans 80 are disposed in such positions as to cool the pressure belt 53, and the operation of the cooling fans 80 is controlled by a control circuit (CPU).

Since the pressure pad 70 is designed to press the pressure belt 53 while the pressure belt 53 is sliding, slippage might be caused due to sliding resistance of the pressure belt 53. The sliding resistance of the pressure belt 53 becomes higher as the temperature of the sliding material of the pressure pad 70 and the pressure belt 53 increase. Therefore, so as to prevent the slippage of the pressure belt 53, it is essential to keep the temperature of the pressure belt 53 lower than the temperature of the fixing roller 51.

In view of the above, the pressure belt 53 of the belt fixing apparatus of this embodiment is separated from the fixing roller 51 every time the fixing operation comes to an end and moves on to a standby state. By doing so, the temperature of the pressure belt 53 is prevented from becoming the same as the temperature of the fixing roller 51. With this structure, a temperature control procedure for lowering the temperature of the pressure belt 53 prior to the start of the next image forming job can be omitted. In other words, the next fixing operation can be started simply by bringing the pressure belt 53, which is maintained at a lower temperature than the fixing roller 51, into contact with the fixing roller 51. As a result, so-called "first print time" can be dramatically shortened.

Figure 3:
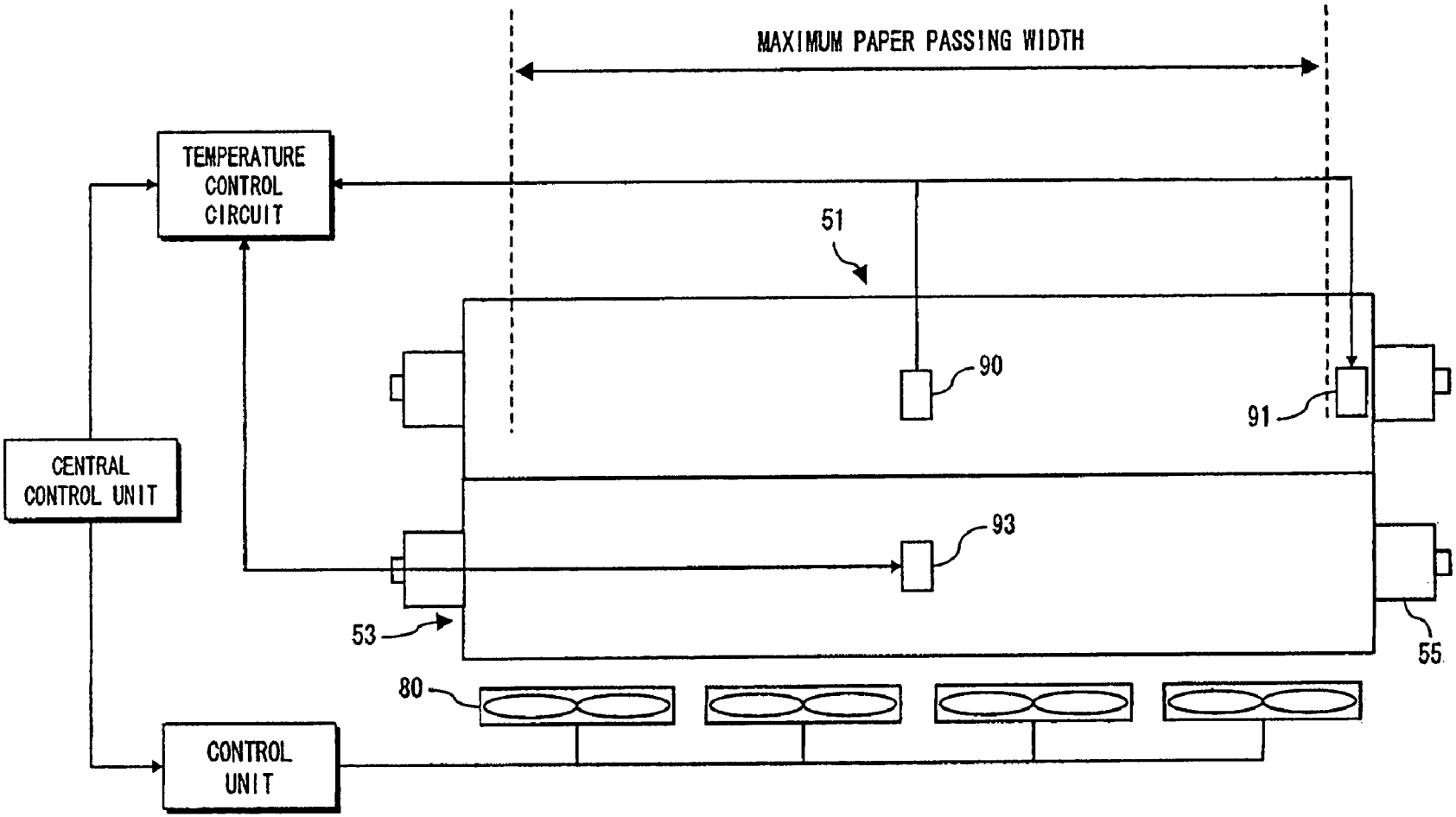
FIG. 3 is a schematic diagram of the fixing apparatus in accordance with the present invention.

Referring now to FIG. 3, the arrangement of the fixing unit 9 in the longitudinal width direction is described.

As shown in FIG. 3, the main thermistor 90 located at the center and the sub thermistor 91 located at an end of the fixing roller 51 are in contact with the fixing roller 51. The sub thermistor 91 is disposed outside the maximum width that can be used for image formation. The belt thermistor 93 is brought into contact with the pressure belt 53.

The main thermistor 90, the sub thermistor 91, and the belt thermistor 93 are connected to the temperature control circuit. Through the temperature control circuit (CPU), the operation of the heater is controlled so that the temperature to be detected by each thermistor becomes the target temperature. As described above, the target temperature of the pressure belt 53 is set lower than the target temperature of the fixing roller 51.

The four cooling fans 80 as a cooling unit are arranged in the longitudinal direction of the pressure belt 53, and the operation of the cooling fans 80 is controlled by a control unit. The temperature control circuit and the control unit of the cooling fans 80 are controlled by a central control unit.

Figure 4:
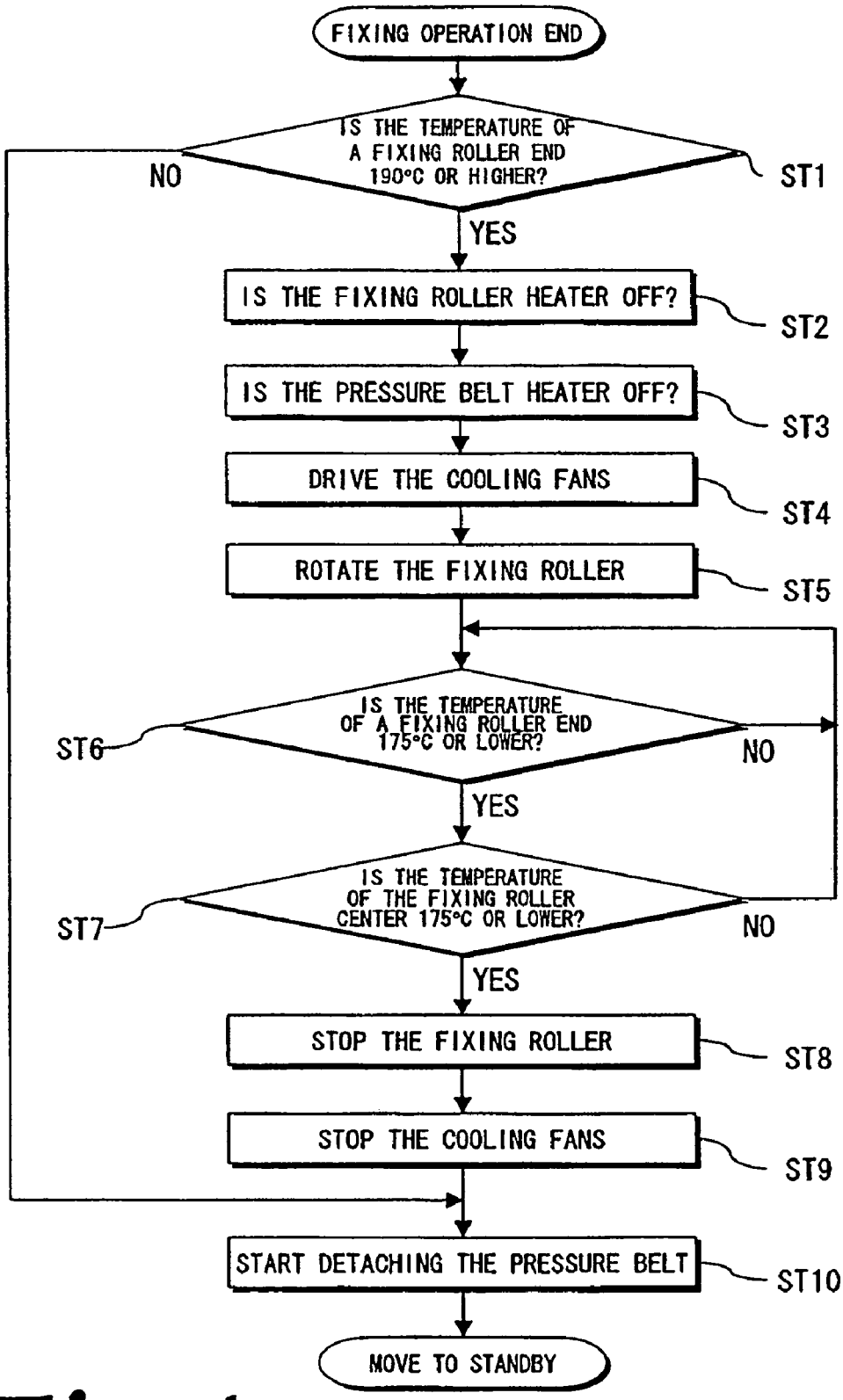
FIG. 4 is a flowchart of the operation after a fixing operation ends in an image fixing operation in accordance with the present invention.

Next, the operation that follows the fixing operation is described. FIG. 4 is a flowchart of the operation that is performed after the fixing operation in accordance with the present invention.

As shown in FIG. 4, when a print job and a fixing operation are ended, the sub thermistor 91 detects the temperature at an end of the fixing roller 51 (step ST1). If the detected temperature is 190° C. or lower in step ST1, the pressure belt 53 is immediately separated from the fixing roller 51, and the operation moves on to a standby state in step ST10. If the detected temperature is 190° C. or higher, the temperature of the fixing roller 51 is determined to have increased abnormally, and the operation moves on to a procedure for cooling the fixing roller 51 through the pressure belt 53.

In the cooling procedure, the heaters for the fixing roller 51 and the pressure belt 53 are forcibly turned off (steps ST2 and ST3) All the cooling fans 80 are then driven (step ST4). By doing so, the fixing roller 51 is rotated until the temperatures detected by the main thermistor 90 and the sub thermistor 91 of the fixing roller 51 become 175° C. or lower, with the cooling efficiency of the pressure belt 53 being maintained high (step ST5).

When the temperatures detected by the main thermistor 90 and the sub thermistor 91 become 175° C. or lower, the fixing roller 51 and the cooling fans 80 are stopped (steps ST8 and ST9). In other words, when the temperature of one end of the fixing roller 51 and the temperature of the center portion of the fixing roller 51 become 175° C. or lower ("YES" in step ST6 and "YES" in step ST7), the fixing roller 51 and the cooling fans 80 are stopped (steps ST8 and ST9). The operation then moves on to step ST10, and the pressure belt 53 is separated from the fixing roller 51. Thus, the device is put into a standby state.

Figure 5:
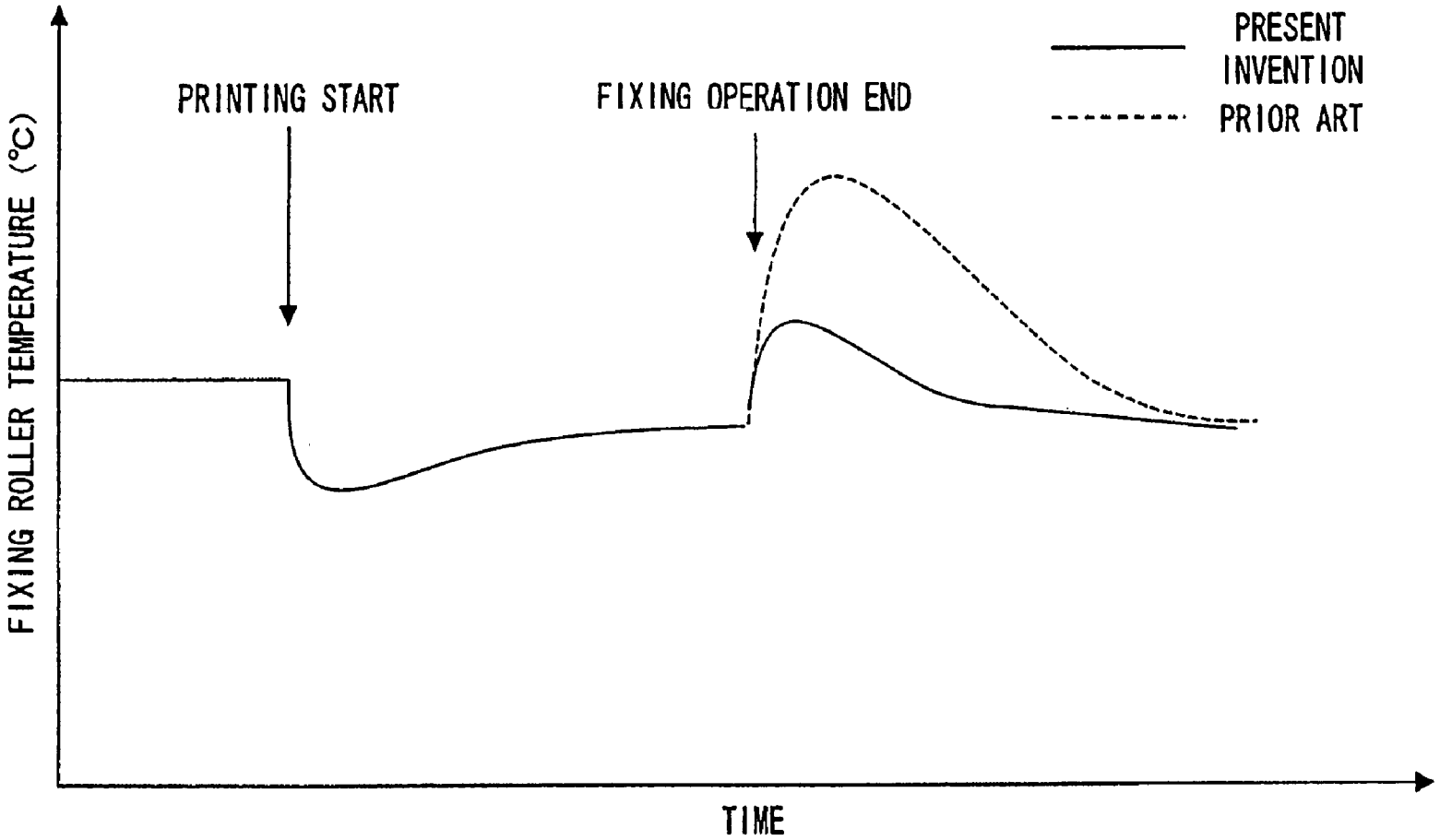
FIG. 5 shows a temperature change of the fixing roller of an embodiment of the present invention in comparison with a temperature change in the prior art.

FIG. 5 shows the results of verification experiments conducted for the image forming apparatus in accordance with this embodiment. During a printing operation, quality paper having a basis weight of 128 g/m$^2$ is employed as a recording material, and a fixing operation is performed for 50 sheets per minute. In FIG. 5, the solid line indicates the temperature change on the surface of the fixing roller 51 of this embodiment, and the broken line indicates the temperature change in a case where the operation moves on to a standby state immediately after a fixing operation in a conventional apparatus.

As can be seen from FIG. 5, the temperature rise after the printing in this embodiment is smaller than that in the conventional case. In the conventional case, the temperature of the surface of the fixing roller 51 increases to 210° C. due to the abnormal temperature rise after the fixing operation. If the next printing operation starts in such a situation, image defects such as an offset due to a high temperature are caused.

So as to prevent the high-temperature offset, a waiting period is required until the temperature of the fixing roller 51 drops to the desired temperature. However, such a waiting period results in downtime during which printing cannot be performed for 5 or more minutes, and the usability decreases.

As the abnormal temperature rise observed in this embodiment is up to approximately 190° C., the high-temperature offset and downtime are not caused. Such an abnormal temperature rise becomes prominent especially with heavy paper such as cardboard that easily loses a large quantity of heat, because the temperature control is performed on the fixing roller 51, with the quantity heat to be lost to the recording material during the fixing operation being taken into account. More specifically, the heat accumulated on the core metal of the fixing roller 51 cannot be discharged after the fixing operation. As a result, the temperature of the surface of the fixing roller 51 overshoots the target temperature after the fixing operation.

So as to cool the fixing roller 51, the inventor tried the method of subjecting the fixing roller 51 directly to the cooling fans 80. However, the cooling by the cooling fans 80 does not provide a uniform cooling efficiency. As a result, temperature unevenness was caused on the surface of the fixing roller 51, and partially defective fixing and luster unevenness were observed. In the present invention, on the other hand, the heat accumulated on the core metal of the fixing roller 51 is discharged to the pressure belt 53, and the cooling fans 80 cool the pressure belt 53, thereby releasing the heat from the fixing roller 51 and restraining the abnormal temperature rise. In short, the fixing roller 51 is cooled via the pressure belt 53 in this embodiment.

During the cooling procedure immediately after the fixing operation, the voltage supply to the heater provided in the belt supporting roller 55 is off.

Accordingly, the temperature of the pressure belt 53 has smaller influence on the fixability and luster, and the temperature unevenness on the fixing roller 51 is reduced. Thus, the above mentioned problems can be prevented.

The core metal of the fixing roller 51 has excellent heat conduction, and the temperature at each end of the core metal increases as the heat is accumulated on the core metal at the time of fixing. Since the heat discharge to the recording material is not caused outside the maximum paper passing width for recording materials, the surface temperature tends to rise with the temperature rise of the core metal of the fixing roller 51 at the time of fixing. Therefore, in this embodiment, the control device checks for abnormal temperature rises through the temperatures detected by the sub thermistor 91 as a temperature detector placed outside the maximum paper passing width. In this manner, the control of the cooling fans 80 after the fixing operation is controlled.

In the above described structure, the cooling period is varied in accordance with the detected temperature of the fixing roller 51 during the procedure for cooling the fixing roller 51 by the cooling fans 80 via the pressure belt 53. However, the following structure may also be employed.

In a case where the cooling power of the cooling fans can be switchable between two levels, for example, the cooling power of the cooling fans is varied in accordance with the detected temperature of the fixing roller in the procedures for cooling the fixing roller via the pressure belt. More specifically, the cooling power is set higher when the temperature of the fixing roller is equal to or higher than a predetermined temperature. The cooling power is set lower when the temperature of the fixing roller is lower than the predetermined temperature. With this structure, the time required for the cooling procedures can be dramatically reduced, and the power consumption by the cooling fans can be restrained.

Since several cooling fans are aligned in the width direction of the pressure belt, the number of operating cooling fans may be changed in accordance with the detected temperature of the fixing roller, to achieve the same effects as the above.

As described so far, when an abnormal temperature rise is caused in the fixing roller 51, the pressure belt 53 is cooled by the cooling unit that is provided against abnormal temperature rises of the fixing roller 51. By doing so, the next image forming job can be started instantly, and the usability can be increased.

As described above, the image forming performance on a recording material with a large heat quantity such as cardboard can be maintained while belt slippage is prevented. At the same time, a decrease in usability due to a high-temperature offset and downtime caused by an abnormal temperature rise of the fixing roller can be prevented.

(Second Embodiment)

Next, an image forming apparatus in accordance with a second embodiment is described. The image forming apparatus in accordance with this embodiment has the same structure as the apparatus of the first embodiment (see FIG. 1).

However, the image forming apparatus of this embodiment differs from the apparatus of the first embodiment in that an abnormal temperature rise is determined by the basis weight and the number of recording materials (numeric value) used in a print job. FIG. 6 is a table that shows the correspondence between the basis weight and the numeric value that is used for determining an abnormal temperature rise.

After the basis weight and the numeric value for a print job are set, if the value is "0" according to the table of FIG. 6, it is determined that an abnormal temperature rise is not to be caused. In such a case, the pressure belt 53 is separated from the fixing roller 51 immediately after the fixing operation, and the operation moves on to a standby state.

If the value is "1", it is determined that an abnormal temperature rise is to be caused. In such a case, the operation moves on to the procedure for cooling the fixing roller 51 via the pressure belt 53 as in the first embodiment. After a certain period of time has passed, the operation of the cooling fans 80 is stopped, and the pressure belt 53 is separated from the fixing roller 51. The apparatus is then put into a standby state.

The period of time for driving the cooling fans 80 is preferably varied in accordance with the basis weight and the numeric value. By doing so, the temperature of the fixing roller 51 can be suitably set.

Furthermore, an abnormal temperature rise is determined by the basis weight and the numeric value in each print job. Accordingly, there is no need to provide a sub thermistor at an end of the fixing roller. Thus, the same effects as those of the first embodiment can be achieved by a simpler structure.

The execution of the fixing roller cooling procedure via the pressure belt, and the cooling power and the cooling period in the case of carrying out the cooling procedure are determined by at least one of the basis weight of the recording material and the number (the numeric value) of the recording materials fixed in each print job.

Since a sub thermistor is not provided at an end in this embodiment, the core metal of the fixing roller may have poor heat conduction in the longitudinal direction. More specifically, an iron core may be employed for the fixing roller. Accordingly, a known induction heating method and device can be employed for the method and device for heating the fixing roller. Also, the metal core may be thinned to shorten the time required for startup.

Furthermore, the efficiency in image forming on cardboard can be maintained while slippage of the pressure belt is prevented. Thus, a decrease in usability due to a high-temperature offset and downtime caused by an abnormal temperature rise can be prevented.

(Third Embodiment)

Figure 7:
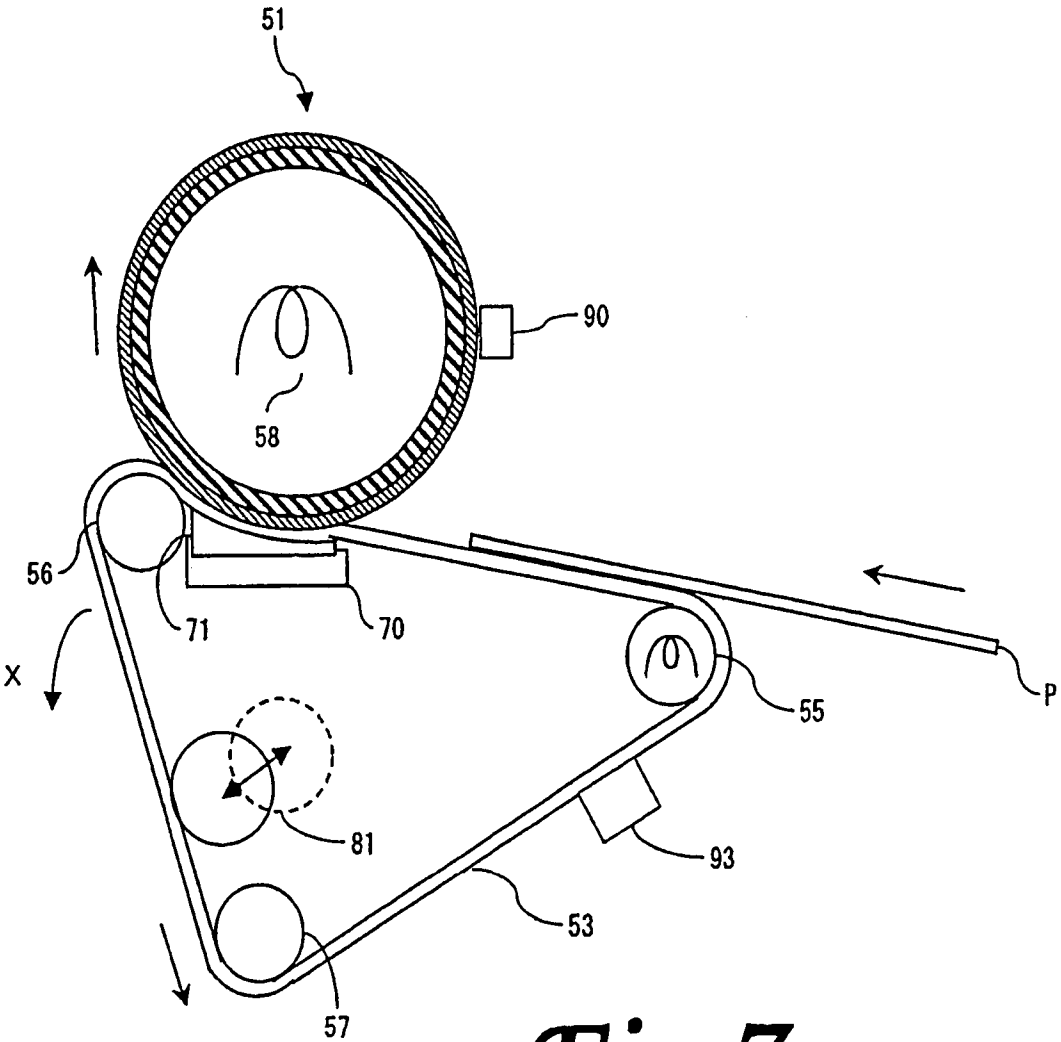
FIG. 7 is a schematic diagram of a belt-type fixing apparatus in accordance with the present invention.

Next, an image forming apparatus in accordance with a third embodiment of the present invention is described. The image forming apparatus in accordance with the third embodiment has the same structure as the apparatus of the first embodiment (see FIG. 1). FIG. 7 illustrates the fixing apparatus in accordance with the third embodiment.

As shown in FIG. 7, the fixing apparatus in accordance with the third embodiment differs from the fixing apparatus of the first embodiment in that a cooling roller 81 is employed as a cooling unit. The other aspects of the structure are the same as those of the first embodiment, and therefore, explanation of them is omitted herein.

The cooling roller 81 is a solid-core roller made of Al with an outer diameter of 20 mm. It is also possible to employ a material with excellent heat conduction such as copper or a heat pipe.

Figure 8:
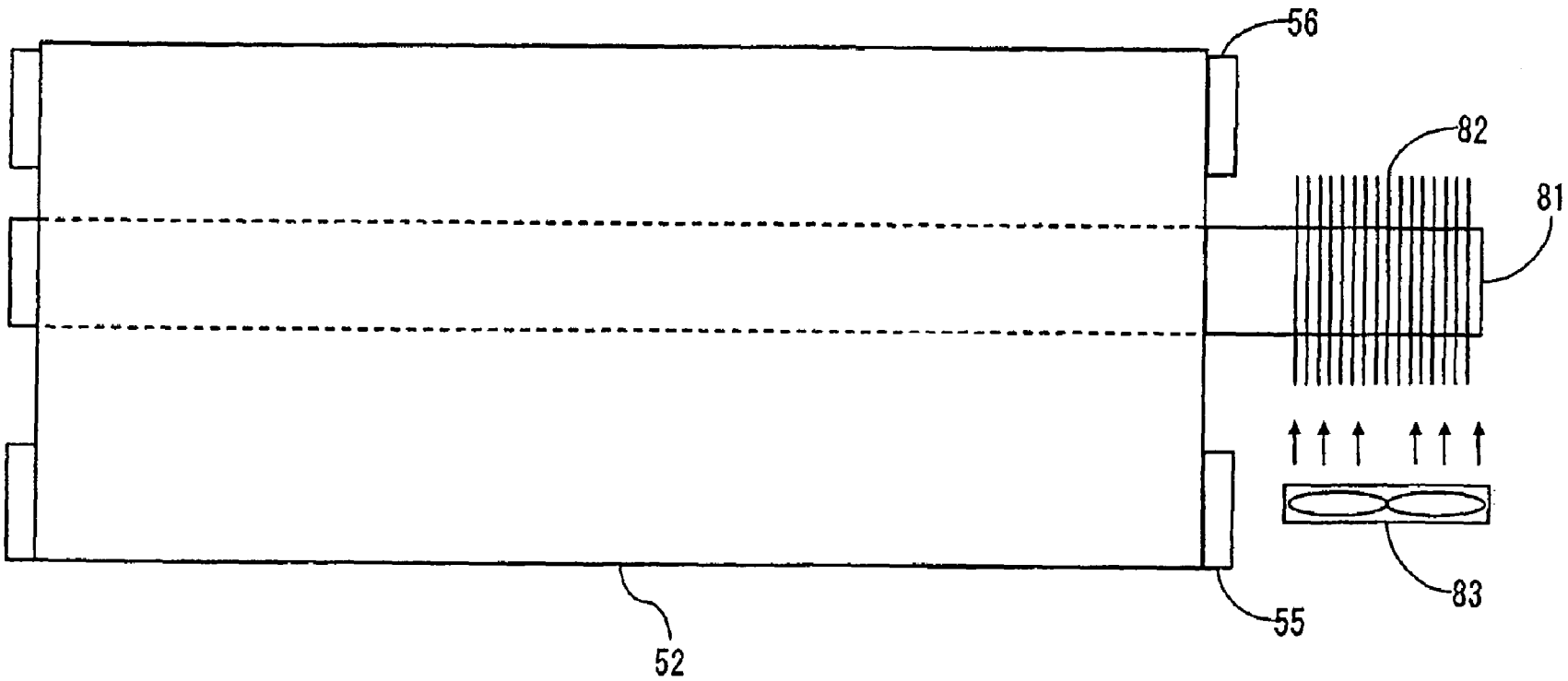
FIG. 8 is a plan view of another belt-type fixing apparatus in accordance with the present invention.

FIG. 8 shows the belt, seen from the fixing roller. A cooling fin 82 is provided at an end of the cooling roller 81 as shown in FIG. 8, and the cooling fin 82 is cooled by a cooling fan 83. Instead of employing the cooling fan 83 for cooling the cooling fin 82, it is also possible to dispose the cooling fin 82 in the air trunk of the exhaust heat duct in the apparatus.

The cooling roller 81 is equipped with a detachable mechanism (not shown), and is detachably attached to the inner surface of the pressure belt 53.

In this embodiment, the sub thermistor 91 located at an end of the fixing roller 51 detects abnormal temperature rises as in the first embodiment. In a case where an abnormal temperature rise is to be caused, the procedure for cooling the fixing roller 51 via the pressure belt 53 is carried out before the apparatus is put into a standby state after the fixing operation.

During the cooling procedure, control is performed in accordance with almost the same flow as in the first embodiment, and the cooling roller 81 is brought into contact with the inner surface of the pressure belt 53 at the same timing of operation of the cooling fan 83. Thus, the same effects as those of the first embodiment can be achieved.

Although the cooling procedure is controlled and varied in accordance with the detected temperature of the fixing roller in this embodiment, the present invention is not limited to this example. For example, the cooling procedure may be controlled and changed in accordance with the basis weight of recording materials or the number of recording material on which fixing is performed in an image forming job, as in the second embodiment. By doing so, the same effects as above can also be achieved.

With the structure in accordance with this embodiment, an abnormal temperature rise of the fixing rotating member after the fixing operation can be prevented. Accordingly, a high-temperature offset can be prevented during each fixing operation in the next image forming job. Also, the time required for starting the next image forming job can be dramatically shortened.

Although the preferred embodiments of the present invention have been described so far, the present invention is not limited to those specific examples, and various modifications may be made to them within the scope of the present invention.

This application claims priority from Japanese Patent Application No. 2004-308089 filed Oct. 22, 2004, which is hereby incorporated by reference, herein.

What is claimed is:

1. A fixing apparatus comprising:

a fixing rotating member that heat-fixes an image on a recording material at a fixing nip;

a belt that forms the fixing nip with the fixing rotating member;

a controller that controls the temperature of the fixing rotating member;

a contact and separation mechanism that brings the belt into contact with the fixing rotating member and separates the belt from the fixing rotating member; and a cooling device that cools the belt, wherein the belt is separated from the fixing rotating member after a cooling operation of the fixing rotating member via the belt is performed when the temperature of the fixing rotating member at the end of the fixing operation is high, and the belt is separated from the fixing rotating member immediately when the temperature of the fixing rotating member at the end of the fixing operation is low.

2. A fixing apparatus as claimed in claim 1, wherein cooling power of the cooling device is varied in accordance with the temperature of the fixing rotating member at the end of the fixing operation.

3. A fixing apparatus as claimed in claim 1, wherein whether the cooling operation is to be performed is determined in accordance with the temperature of a non-passing portion of the fixing rotating member.

4. A fixing apparatus comprising:

a fixing rotating member that heat-fixes an image on a recording material at a fixing nip;

a belt that forms the fixing nip with the fixing rotating member;

a controller that controls the temperature of the fixing rotating member; and a cooling device that cools the belt, wherein the belt is separated from the fixing rotating member after a cooling operation of the fixing rotating member via the belt is performed when the number of recording materials on which the fixing operation is performed is large, and the belt is separated from the fixing rotating member immediately after the fixing operation ends when the number of recording materials on which the fixing operation is performed is small.

5. A fixing apparatus as claimed in claim 4, wherein a cooling time under the cooling operation is changed in accordance with the number of recording materials on which the fixing operation is performed.

6. A fixing apparatus as claimed in claim 4, wherein cooling power under the cooling operation is changed in accordance with the number of recording materials on which the fixing operation is performed.

7. A fixing apparatus comprising:

a fixing rotating member that heat-fixes an image on a recording material;

a belt that forms the fixing nip with the fixing rotating member;

a controller that controls the temperature of the fixing rotating member; and a cooling device that cools the belt, wherein the belt is separated from the fixing rotating member after a cooling operation of cooling the fixing rotating member via the belt is performed when the basis weight of the recording material is small in a fixing operation, and the belt is separated from the fixing rotating member immediately after the fixing operation ends when the basis weight of the recording material is large in the fixing operation.

8. A fixing apparatus as claimed in claim 7, wherein a cooling time is changed in accordance with the basis weight of the recording material in the fixing operation.

9. A fixing apparatus as claimed in claim 7, wherein cooling power is changed in accordance with the basis weight of the recording material in the fixing operation.

* * * * *